United States Patent [19]

Kuhn et al.

[11] 4,186,517

[45] Feb. 5, 1980

[54] DOLL WITH ARM-ACTUATED FINGERS

[75] Inventors: James O. Kuhn, New York, N.Y.; James J. Wright, Loveland; Howard N. Bollinger, Cincinnati, both of Ohio

[73] Assignee: CPG Products Corp., Minneapolis, Minn.

[21] Appl. No.: 875,729

[22] Filed: Feb. 7, 1978

[51] Int. Cl.[2] ..... A63H 3/46

[52] U.S. Cl. ..... 46/119; 46/163

[58] Field of Search ..... 46/119, 163, 118, 120, 46/117

[56] References Cited

U.S. PATENT DOCUMENTS

| | | | |
|---|---|---|---|
| 440,986 | 11/1890 | Alderson | 46/119 |
| 535,202 | 3/1895 | Hawes | 46/119 X |
| 2,733,545 | 2/1956 | Guadagna | 46/163 X |
| 3,071,893 | 1/1963 | Schwartz | 46/163 |
| 3,693,288 | 9/1972 | Lewis et al. | 46/119 |
| 3,731,427 | 5/1973 | Lewis et al. | 46/120 X |
| 3,867,785 | 2/1975 | Ryan et al. | 46/117 |

*Primary Examiner*—John F. Pitrelli

*Attorney, Agent, or Firm*—G. O. Enockson; L. M. Lillehaugen

[57] ABSTRACT

Actuating linkage contained within each arm and hand of the doll causes the three middle fingers of either hand to be flexed from an extended relation to a clenched condition when the arm for that particular hand is raised. When the arm is lowered, then the middle fingers are automatically unclenched. The clenching action is independent of whatever degree of wrist rotation may exist.

21 Claims, 9 Drawing Figures

10
12
14
16
18
20
22
24
26
28
30
32
34
36
38
40
42
44
46
48
52
54
56
58
60
61
62
110
112
114
116
118
120
122
124
126
130
132
134
136

61
180
102c
192
106a
102b
106b
102a
86b
86a
74
72
54
78
80
82
64
68
50
92a
92b
76
66
160
188
168
70
71
158
48
161
152
156
154
148
140
38
56
59
58
178
60
62
182
84
86
88
98
90
94
107
108
109
92
96
166
150
147

DOLL WITH ARM-ACTUATED FINGERS

BACKGROUND OF THE INVENTION

1. Field of the Invention

This invention relates generally to dolls, and pertains more particularly to a doll possessing life-like finger movement produced as the doll's arm is raised and lowered.

2. Description of the Prior Art

It is, of course, not new to incorporate various types of finger and thumb movements in doll constructions. However, where hidden levers must be manipulated in order to produce the finger movement, small children are not able to manipulate the levers required because they are hidden, or if prominently displayed, then the amount of manual effort required cannot be supplied by a relatively small youngster.

Owing to the difficulties that have been encountered in the past, designers of toy dolls have sacrificed some of the realism in order to render the hands more readily actuatable. Even so, frequently it turns out that small children are incapable of performing the functions that are intended to be performed.

Hence, a need still exists for a simple doll in which its hands can be readily manipulated into an open or closed condition for the purpose of grasping and releasing various objects.

OBJECTS AND SUMMARY OF THE INVENTION

Accordingly, one object of the present invention is to provide a doll having several flexible fingers on each hand which are actuated automatically into a clenched or closed condition when the arm for that hand is raised, and conversely into an open or unclenched condition when the arm is lowered. More specifically, an aim of the invention is to provide the necessary mechanical advantage for flexing three fingers on each hand by incorporating an actuating mechanism in each arm and hand so when that particular arm is raised, then the fingers for the hand associated therewith will be automatically flexed.

Another object of the invention is to provide a doll with fingers capable of being flexed that can be handled and used by relatively small children, more specifically as young as three years or so of age.

A further object is to provide a doll having fingers on each hand which can be actuated into a clenched or closed condition independently of the fingers on the other hand. In this regard, it is within the purview of the invention to raise and lower either arm and thereby actuate the fingers on the hand for that particular arm. Consequently, both arms can be raised to cause the fingers of both hands to become clenched, or each arm can be raised independently of the other to produce a clenched or closed condition for only the fingers of that particular hand.

Yet another object of the invention is to provide a doll in which the hands can be manipulated into a grasping condition so as to hold onto the fingers of the child, imparting a realistic feel to the youngster's fingers by reason of the gentle squeezing action from the doll's hands. In this regard, the youngster's fingers can be grasped tight so that the doll can be helped to walk. As far as the walking action is concerned, it is planned that the doll's legs be pivotally mounted so as to permit the doll to take steps with each foot while its hands are grasping the child's fingers.

A further object is to provide a doll having the foregoing capabilities and in which the fingers possess a lifelike appearance, whether clenched or open. In this regard, there are no visible lines of separation at any of the joints where the bending of the fingers occurs.

Inasmuch as each hand can be closed and opened independently of the other, this being achieved by merely raising the arm for that hand, a specific object of the invention is to enable the doll to grasp a rattle or a squeaker and firmly hold onto such an item. Consequently, an aim of the invention is to provide a doll that possesses considerable versatility as far as the objects held onto by the doll.

Still another object is to provide a doll of the foregoing character that is exceedingly rugged and not apt to be broken. In this regard, an aim of the invention is to permit either or both arms to be raised and yet not produce breakage of the linkage should the child swing the arm through a complete circle.

A further object of the invention is to provide a doll possessing any desired angle of wrist rotation, and at the same time not having the degree of wrist rotation in any way adversely affect the raising and lowering of the doll's arms.

Briefly, the doll has two pivotally mounted arms which can be swung upwardly and downwardly about axes at the doll's shoulders. Each hand at the lower end of its particular arm is provided with three flexible middle fingers. By offsetting the upper end of actuating linkage contained within each arm and hand of the doll, doing so downwardly with respect to the shoulder axis, the raising of either arm will automatically cause the flexible fingers to be flexed into a closed or clenched condition when the arm is raised and fingers to be opened or unclenched when the arm is returned to its lower position.

Each hand is mounted at its wrist for rotation with respect to the arm, and provision is made at an intermediate portion of the linkage so that rotation of the linkage can take place along the same axis as the wrist rotation takes place, thereby permitting the hand to be angled to any degree with respect to the arm and still permit the actuating mechanism to function properly.

It is also planned that the legs be pivotally attached to the torso of the doll so as to permit the doll to be walked while the hands are grasping the fingers of the child. Inasmuch as the fingers are individually operated into closed and open conditions, various objects, such as rattles and squeakers, can be held and manipulated by the doll's hands and fingers.

DESCRIPTION OF THE PREFERRED EMBODIMENT

Figure 1:
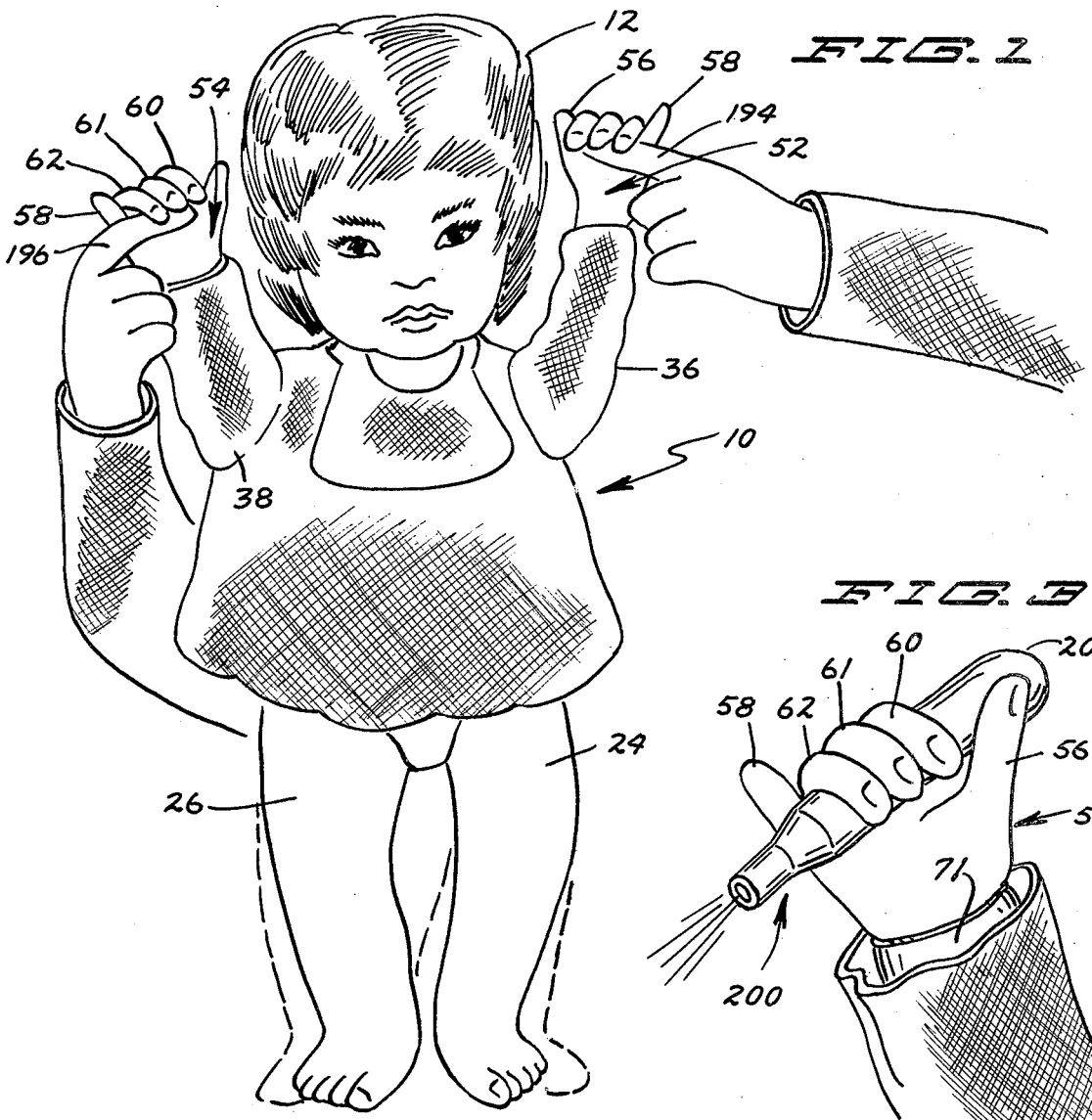
FIG. 1 illustrates a doll constructed in accordance with the invention, the doll grasping the fingers of a child so as to facilitate a walking of the doll.

In FIG. 1 a fully clothed doll 10 has been pictured which is constructed in accordance with the teachings of the invention. As is conventional, the doll 10 has a head 12 and a neck 14 preferably of relatively soft vinyl. From FIGS. 4 and 5, it can be discerned that the neck 14 is formed with a groove 16. The head 12 is mounted at the upper end of a torso denoted generally by the reference numeral 18, preferably of polystyrene or high density polyethylene. More specifically, the torso 18 is formed with an opening 20 at its upper end, the opening 20 having a diameter corresponding substantially to that of the groove 16. In this way, the peripheral portion of the plastic material constituting the torso 18 which is circumjacent the opening 20 extends into the groove 16 so as to mount the head 12 to the torso 18 and at the same time permit the head 12 to be turned or rotated about a generally vertical axis denoted by the numeral 22.

Further included in the doll 10 is a pair of legs, preferably of the same plastic material as the head 12, the left leg being designated by the numeral 24 and the right leg by the numeral 26. As best understood from FIG. 4, and to a degree from FIG. 5, the legs 24, 26 have a groove 28 at the upper or thigh end which is engaged in a pair of openings 30, one for each leg, in the torso 18. In this way, the legs 24 and 26 are mounted for pivotal movement about angled pivotal axes denoted by the reference numerals 32 and 34, respectively. Although not entirely understandable at this stage of the description, the manner in which the legs are mounted for pivotal movement about the axes 32, 34 enable the doll 10 to be walked in a manner hereinafter made manifest.

It might be explained at this point, though, that the torso 18 is molded as two sections or shells which are secured together, such as with an appropriate adhesive. By employing two plastic shells, it will be appreciated that the opening 20 is formed when the two shells are placed together and in this way marginal portions circumjacent the opening 20 extend into the groove 16. The same thing holds true for the grooves 28, for they are also formed when the two torso sections or shells are placed together. Once the shells are bonded together, then the head 12 remains pivotally connected to the torso 18 and the legs 24 and 26 are also pivotally held in place.

At this time, attention is called to a pair of arms, the left arm being identified by the reference numeral 36 and the right arm by the numeral 38. As the description progresses, it will be seen that the arms 36, 38 should be of rigid plastic material. Here again, the arms 36, 38 are composed of sections or shells that are secured together, and can be of the same plastic as the torso 18 and legs 24, 26. Since the arms 36, 38 must be relatively rigid, and for the sake of appearances match the torso 18 and legs 24, 26, it follows that all of these body members comprising the doll 10 should be of the same material. High density polyethylene and polystyrene, as well as other plastics, provide the requisite degree of rigidity for the arms 36, 38 and hence is recommended for the torso 18 and legs 24, 26, as well.

By molding the arms 36, 38 in two sections, a groove 40 is formed at the shoulder or upper end of each of the arms 36, 38. By means of openings 42, there being one at each side of the torso 18, the arms 36 and 38 are pivotally mounted to the torso 18 for swinging or swivel movement about pivotal axes 44 and 46. As with the head 12 and legs 24, 26, it is the assembling of the composite sections or shells constituting the torso 18 that enables the arms 36, 38 to be individually pivoted or independently swung about the axes 44, 46.

Whereas the arms 36 and 38 are formed of relatively rigid plastic material, and it has already been explained that they are constructed of two sections or shells, it can be pointed out at this stage that, when assembled together, a cylindrical bore 48 is formed at the lower end of each arm 36, 38 for a purpose hereinafter made clear. The bores 48, there being one for each arm 36 and 38, can be seen in FIG. 4, but are better viewed in FIGS. 7 and 8. In addition to forming the bore 48 when the arm or shell sections are secured together to form the arms 36 and 38, a wrist opening 50 is also formed.

Whereas an actuating linkage or mechanism is contained in each arm 36, 38 and projects through each wrist opening 50, the description of these mechanisms is better reserved for later discussion.

Mounted at the lower end of the left arm 36 is a hand denoted generally by the reference numeral 52, and carried at the lower end of the right arm 38 is a hand 54. Each hand 52 and 54 includes a rigid thumb 56 and a rigid little finger 58. However, the middle three fingers, that is the index finger which has been labeled 60, the middle finger labeled 61 and the ring finger 62, are flexible, being capable of being flexed from an extended condition, such as that shown in solid outline in FIG. 7, to a curved or bent ondition, such as that shown in phantom outline in FIG. 7. The clenched or closed condition of the fingers 60, 61 and 62 of each hand 52 and 54 is also depicted in FIG. 1, and the clenched condition of the fingers 60, 61 and 62 for the right hand 54 is additionally illustrated in FIG. 3. More will be said later on concerning the construction of the flexible fingers 60, 61 and 62 and the manner in which they are flexed. At this time, it need only be pointed out that the fingers 60, 61 and 62 are realistically flexed so as to simulate human fingers, the simultaneous bending of each set of fingers being achieved via actuating mechanisms still to be described. However, the thumb 56 and the little finger 58 are rigid, as already indicated, and are not flexed since the flexing of just three fingers on each hand is adequate to impart a sufficiently human-like movement to the fingers so as to be highly appealing to the child.

Owing to the construction of the fingers 60, 61 and 62, in order to enhance the cosmetic appearance of each hand 52 and 54, a resilient cover or latex glove 64 encompasses all of the parts of each hand that otherwise would be exposed to view. Included in the skeletal parts that are concealed by the cover or glove 64, which are in addition to those already mentioned, is a lower shell or section 66 that constitutes the palm portion of the hand, and a complemental part or shell labeled 68 that constitutes the upper or back of the hand. These parts or shells 66, 68 are best viewed in FIG. 9, appearing in an exploded relation in this particular figure. Like the arms 36, 38, the parts 66, 68 can be fabricated from high density polyethylene or polystyrene. When secured together they form a groove 70 extending around the wrist end of each hand 52, and 54. It might be helpful to label the lower portion of the groove 70 with the numeral 70*a* in FIG. 9 and the upper portion of the groove 70 by the numeral 70*b*. Inasmuch as the cover or glove 64 should extend into the opening 48, a split protective ring 71 is snapped over the outside of the wrist portion of the two hands 52 and 54, the snap ring 71 serving as a bearing for facilitating wrist rotation in addition to protecting the relatively soft latex cover 64 in this region.

It has already been mentioned that the thumb 56 is rigid and that the little finger 58 is also rigid. The rigidity is imparted to these digital members by way of a rigid thumb portion 56*a* integral with the lower shell 66 which as already indicated forms a skeletal portion of the right hand 54. Rigid little finger portions 58*a* and 58*b*, when the two shells or parts 66 and 68 are secured together, provide the rigidity for the little finger 58.

Figure 9:
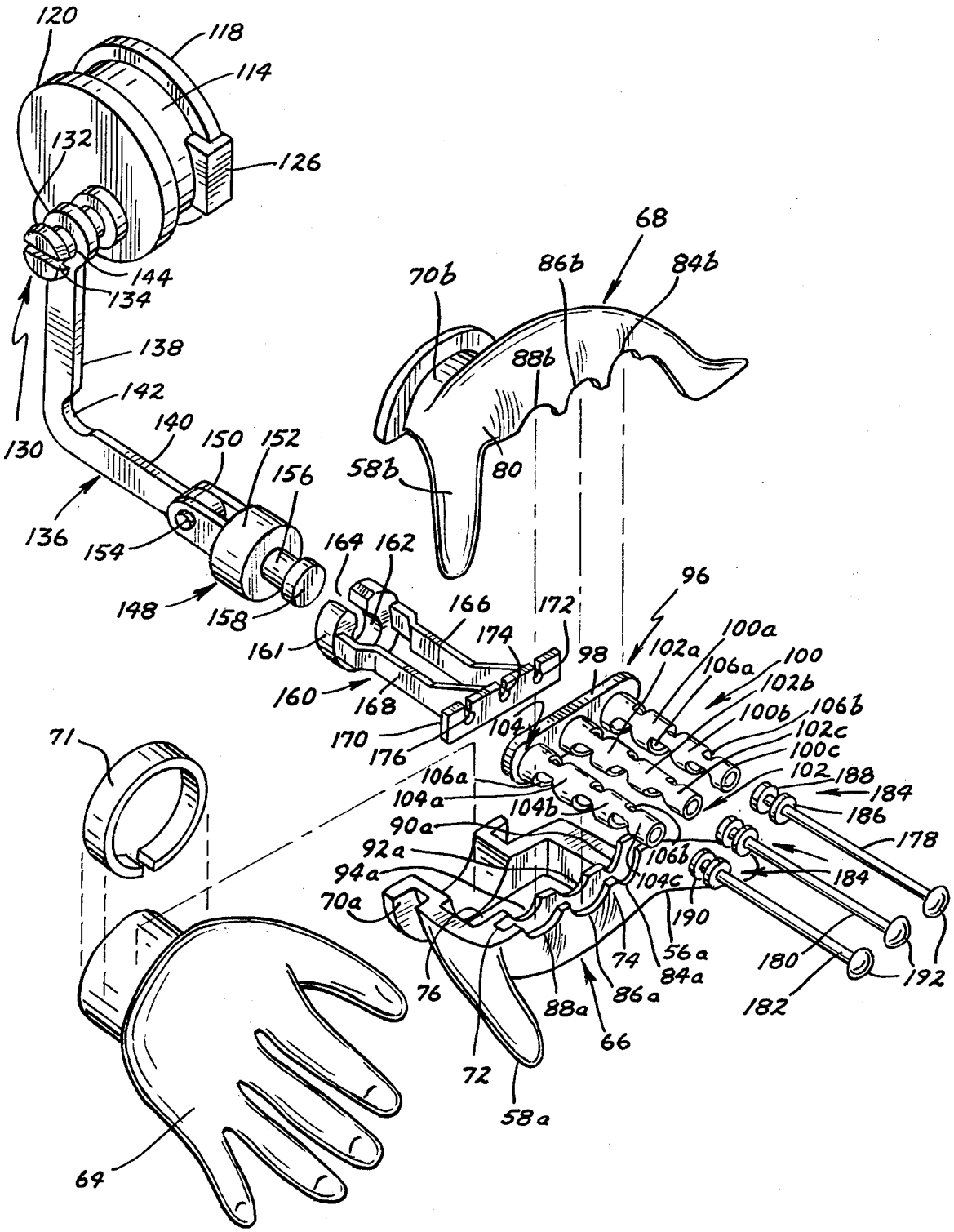
FIG. 9 is an exploded perspective view of the actuating linkage for the right arm with certain parts of the hand shown to better advantage than in some of the other views.

The hand parts or shells 66 and 68 are specially configured for the accommodation of elements yet to be referred to. However, it can be pointed out that the lower shell 66 is formed with a lower groove 72 having an arcuate shape thereto, as perhaps can best be understood from FIG. 8, although FIG. 9 shows the configuration quite clearly, too. The arcuate groove 72 is formed by flanking ribs 74 and 76 which are integral portions of the lower hand part or shell 66.

Owing to the angle at which the perspective is taken in FIG. 9, one cannot see the upper groove 78 that registers with the lower groove 72. However, it is believed that the showing of the upper groove 78 in FIG. 7 will suffice. Here again, there are flanking ribs 80 and 82 which actually form the upper groove 78 and which abut against the lower ribs 74 and 76 when the two parts 66 and 68 are secured together.

Figures 7, 8:
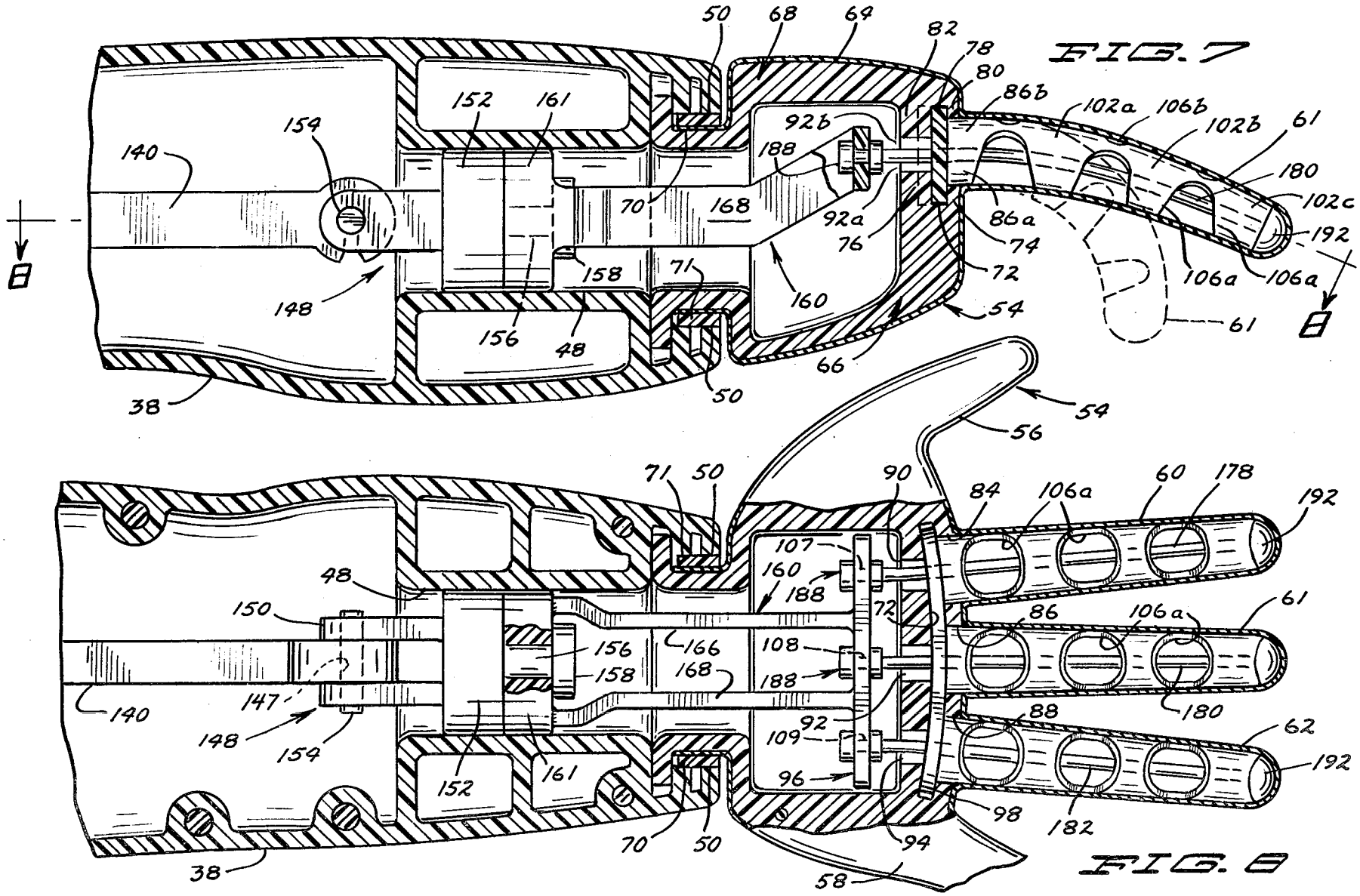
FIG. 7 is an enlarged sectional view of the right forearm and one of the flexible fingers, the view being in the same sectional plane as the sectional plane of the arm positions appearing in FIG. 6.
FIG. 8 is a sectional view taken generally in the direction of line 8—8 of FIG. 7.

From FIG. 8 in particular it can be perceived that passages 84, 86 and 88 extend through the ribs 74 and 80, whereas aligned passages 90, 92 and 94 extend through the ribs 76 and 82. It may help the reader to orient himself better if the semicircular notches in the ribs 74, 76 appearing in FIG. 9 are labeled. In this regard, the semicircular notches identified as 84*a*, 86*a* and 88*a* form the bottom portions of the passages 84, 86 and 88, whereas the semicircular notches 90*a*, 92*a* and 94*a* form the lower portions of the passages 90, 92 and 94. Quite obviously, the upper semicircular notches, which are formed in the ribs 80, 82 are not visible in FIG. 9, for one is viewing the hand part of shell 68 from above. Nonetheless, owing to the plane in which the sectional view constituting FIG. 7 is contained, the upper portions of the passages 86 and 92 do appear and have been labeled 86*b* and 92*b*.

Playing an important role in the practicing of the invention is a finger segment or unit denoted generally by the reference numeral 96. Whereas the members comprising the two mechanisms 110 and 112, as thus far described, can be of nylon or the like, it is intended that the finger segment or unit be more pliable, such as vinyl. The finger segment or unit 96, it will be discerned, includes a base strip 98 that functions somewhat like the transverse carpal ligament in a human hand. Integral with the base strip 98 and projecting from one side thereof are three tapered sleeves or sheaths 100, 102 and 104 which should be capable of facile flexing, such as made possible by using vinyl or a similar plastic for the entire unit 96.

From FIG. 9 it will be observed that each sleeve or sheath 100, 102 and 104 contains lower and upper notches 106*a* and 106*b*, respectively, the lower notches 106*a* being somewhat displaced or out of registry with the notches 106*b* thereabove. In a sense, the notches 106*a*, 106*b* which permit the tapered sleeves or sheaths 100, 102 and 104 to flex far more readily than they otherwise would, produce phalanx-like sections found in a human hand. In this regard, each of the three middle fingers of a human hand have three phalanges formed by articulatively connected together bones. It might be of help to label the sections of the sleeve 100, which form the phalanges for the index finger 68, as 100*a*, 100*b* and 100*c*. Similarly, the phalanx-like sections for the sleeve 102, which forms the finger 61 have been labeled 102*a*, 102*b*, and 102*c*. By the same token, the phalanges-performing sections of the tapered sleeve or sheath 104 have been identified as 104*a*, 104*b* and 104*c* in FIG. 9. Axially or longitudinally aligned with the tubular interiors of the tapered sleeves or sheaths 100, 102 and 104 are holes 107, 108 and 109 formed in the base strip 98 which accommodate tendon-functioning cables included in the actuating mechanisms described below.

For the purpose of flexing the fingers 60, 61 and 62 of each hand 52 and 54 are separate and independent actuating linkages or mechanisms denoted generally by the reference numeral 110 as far as the left arm 36 and left hand 52 are concerned and 112 as far as the right arm 38 and right hand 54 are concerned. Inasmuch as the actuating mechanisms 110 and 112 are identical other than that one is at one side of the doll 10 and the other at the other side, it is only necessary to assign one set of reference numerals for each of the component parts constituting the mechanism 110 or 112.

Accordingly, it will be recognized that a shoulder drum 114, such as nylon, is employed in each actuating mechanism 110, 112. Consequently, one shoulder drum 114 is received in an opening 116 at the left side of the torso 18 and a second such drum 14 is received in an opening 116 at the other side. By reason of an inner flange 118 on the shoulder drum 114, the drum 114 is prevented from moving outwardly, for the flange 118 bears against the portion of the plastic torso 18 surrounding the opening 116. At the other or outer end of the shoulder drum 114 is a flange 120 which bears against the interior of the upper end of the arm 36 in one instance and the arm 38 in the other instance, thereby pivotally connecting the arms 36, 38 to the torso 18 and providing pivotal movement about the shoulder axes 44, 46. To prevent rotation of each drum 114 relative to the torso 18, a pair of lugs or keys 126 on the flange 118 engage in notches or recesses formed in the torso 18.

Projecting from the side or face of the drum 114 having the flange 120 thereon is a pin or capstan-like bearing 130 formed with a beveled retention flange 132 and having a slot 134 extending inwardly from the end with the retention flange 132 thereon, thereby permitting the portions of the flange 132 to be pressed together for a purpose described below.

Of importance in practicing the invention is an angled and somewhat L-shaped pull rod or strip 135 included in each actuating mechanism 110 and 112, each having a rectangular cross section. The rod or strip 136 is formed from a plastic, such as nylon. The cross section and length of the rod 136 are selected so as to render the rod somewhat resilient, the reason for which will become clearer as the description progresses. More specifically, the rod 136 has an upper leg 138, a lower leg 140 and an intermediate or elbow portion formed by an arcuate or curved notch 142, the lower leg 140 extending at an angle to the upper leg 138. The notch 142 facilitates bending of the pull rod or strip 136 at this particular locus. The upper extremity of the leg 138 has a hole 144 therein of a size to fit over the previously mentioned retention flange 132 when the pin or capstan bearing 130 is flexed together as permitted by the inwardly extending slot 134. As can be understood from FIGS. 4 and 9, the hole 144 loosely encircles the bearing 130. Although the reason therefore will not be entirely clear at the moment, the pin or bearing 130 provides a pivot axis 112 offset downwardly from the shoulder axis 44 and a pivot axis 124 offset downwardly from the shoulder axis 46. The offsetting of the axes 122 and 124 from the axes 44 and 46, respectively, is very important, as will soon be recognized.

At the lower extremity of the leg 140 is a hole 147. The hole 147 permits the pull rod 136 to be connected to a pull rod link 148 having a clevis 150 projecting from its cylindrical body 152, the cylindrical body 152 being capable of sliding or reciprocating in the previously mentioned bore 48. A transverse pin 154 extends through the clevis 150 and through the hole 147 in the lower leg 140 of the pull rod or strip 136. A shank 156 projects from the end of the cylindrical body 152 opposite the clevis 150 and has formed thereon an integral head 158.

A tendon coupling unit 160 comprises a coupling ring 161, the ring 161 having a keyhole configuration, more specifically a circular hole 162 centrally located therein and an entrance slot 164 leading radially inwardly. The coupling unit further includes longitudinally directed arms 166, 168 which are integral with a transverse tendon plate 170. The tendon plate 170 has three keyhole slots 172, 174 and 176.

Each actuating mechanism 110, 112 further includes a trio of finger tendons in the form of nylon cables labeled 178, 180 and 182. At one end of each of the tendons or cables 178, 180 and 182 is a spool-like collar 184 having spaced flanges 186, 188 with a smaller diameter neck 190 therebetween. The various necks 190 are received in the keyhole slots 172, 174, 176 and the flanges 186, 188 at each end of the collars 184 prevent any axial movement with respect to the tendon plate 170.

Of course, the tendons or cables 178, 180 and 182 extend through the interiors of the tapered sleeves or sheaths 100, 102 and 104. To prevent the tendons or cables 178, 180, 182 from being pulled through the several sleeves 100, 102 and 104 are buttons or heads 192 secured to the free ends of the tendons or cables 178, 180, 182, the bottoms 192 acting against the distal ends of the tapered sleeves or sheaths 100, 102 and 104 when the actuating mechanism 110 or 112 is operated to flex the fingers 60, 61 and 62 for the hand 52 or 54, as the case may be.

Having presented the foregoing description, the manner in which the flexible fingers 60, 61 and 62 are actuated should be at least generally understood. However, a detailed description of the operation will be helpful in appreciating the full benefits to be derived from a practicing of the invention.

Figures 4, 5:
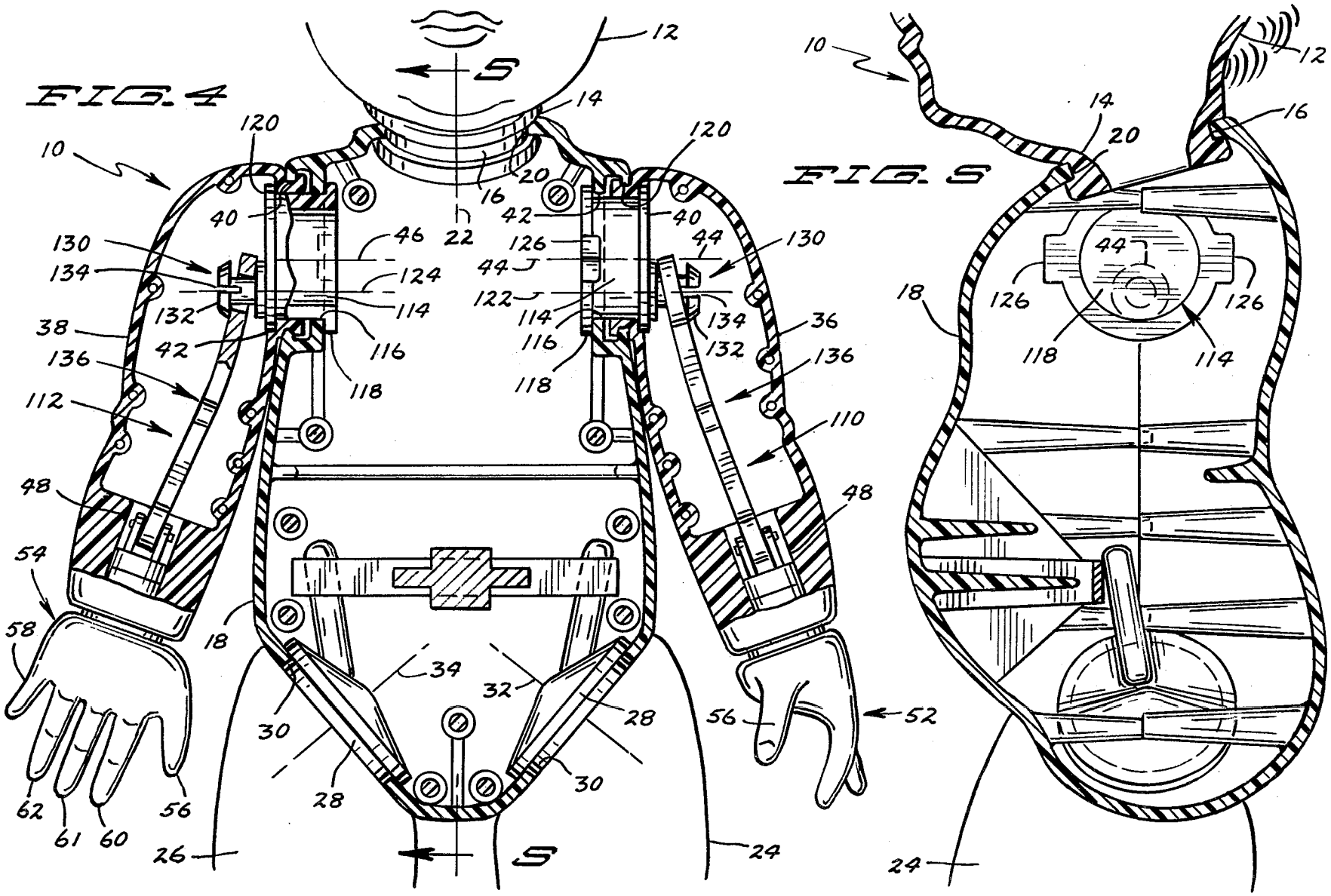
FIG. 4 is an enlarged sectional view taken through the shoulders of the doll.
FIG. 5 is a sectional view taken in the direction of line 5—5 of FIG. 4.
Figure 6:
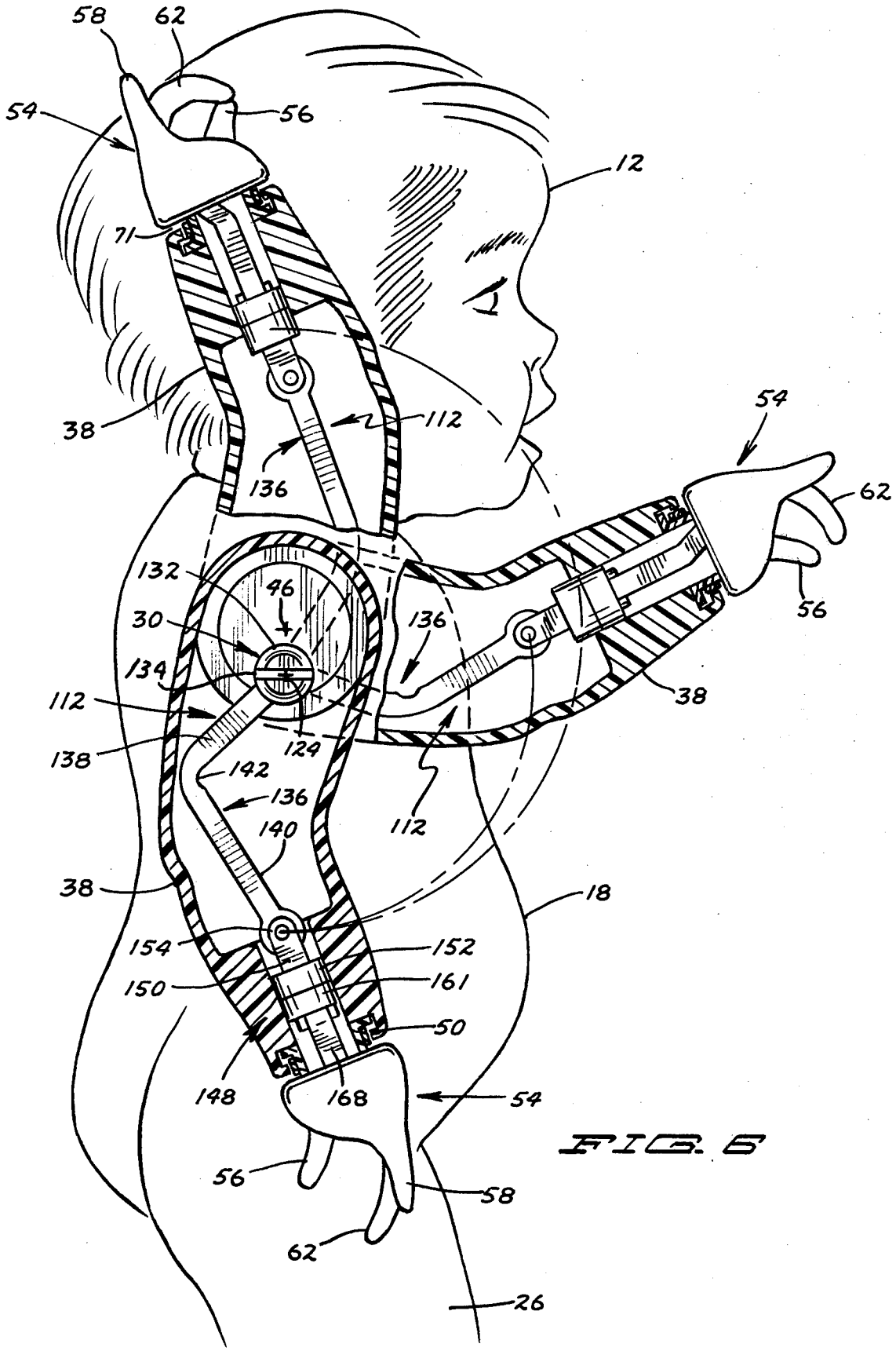
FIG. 6 is a side elevational view of the doll with its right arm shown sectionalized and in three different angular positions which affect the closing of the three middle fingers of the right hand.

Assuming at the outset that both arms 36, 38 are extending downwardly, as depicted in FIG. 4, and as the right arm is depicted in FIG. 6, more specifically, the 6 o'clock position thereof in this latter figure, for two other arm positions are also illustrated in FIG. 6. As a matter of fact, it will be helpful to consider FIG. 6 in detail, for it pictorially describes the action that takes place when the right arm 38 is swung upwardly through a horizontal or 3 o'clock position into a fully raised or 12 o'clock position.

In order to appreciate what takes place, it should be borne in mind that the right arm 38 pivots about the shoulder axis 46. However, the axis 124 provided by the pin or capstan-like bearing 130 at the right side of the doll 10 is displaced or offset beneath the axis 46. Stated somewhat differently, the distance between the axis 46 and the hand 54 is always the same irrespective or any raised condition of the arm 38. However, the distance between the axis 124 and the hand 54 increases when the arm 38 is extending downwardly, as in the 6 o'clock position appearing in FIG. 6, the same when the arm 38 is extending horizontally or in the 3 o'clock position of FIG. 6, and also the same when the right arm 38 has been swung completely upwardly to a fully raised position which corresponds to the 12 o'clock position.

The same is not true, though, as far as the distance from the shoulder axis 46 to the hand 54, for it is greatest when the arm 38 is extending downwardly or in the 6 o'clock position of FIG. 6. When the arm 38 is raised to a horizontal or 3 o'clock position, it can be understood from FIG. 6 that the distance from the axis 146 to the hand 54 becomes somewhat less, and is substantially less when the arm 38 is fully raised. Actually, the distance between the axis 46 and the hand 54, when the arm 38 is fully raised, has been decreased by twice the amount of offsetting between the axes 46 and 145, as contrasted with the distance that exists when the arm 38 is raised.

For the sake of discussion, if the drum 114 is of such size that the axis 124 is displaced 0.8 inch beneath the axis 46, then when the arm 38 has moved from its lowered position to its raised position, that is substantially through 180°, then the distance from the axis 124 to the hand 54 will have increased by two times 0.8 inch or 1.6 inches. In other words, the actuating mechanism 112 (and also 110) contracts virtually, but not entirely, this same amount during a complete raising of the arm 38 (or the arm 36). The bending or the pull rod or strip 136 at the notch 142 precludes a physical shortening of either mechanism 110, 112 in any exact or precise correspondence.

Although the pull rod 136 bends at its notch 142 during the swinging of the arm 38 from its lower position to a raised position, there is sufficient resiliency so that a strong muscle-like pull is exerted via the pull rod 136, the pull rod link 148, the tendon coupling unit 160 and the tendons or cables 178, 180 and 182, so as to cause the several button or heads 192 affixed to the free ends of the tendons 178, 180 and 182 to pull the buttons 192 against the lower or free ends of the sleeves or sheaths. Such pulling action causes the tapered sleeves or sheaths 100, 102 and 104 to flex, the bending being facilitated by virtue of the notches **106*a* and 106*b*. It is believed that the flexing action is adequately portrayed in FIG. 7, for the solid line position of the finger 61 indicates an unflexed or extended condition thereof and the phantom or outline position indicates the flexed condition of this particular finger. Of course, all three fingers 100, 102 and 104 on the hand 38 are flexed simultaneously, owing to the pulling action developed through the agency of the tendon coupling unit 160. It should be borne in mind that the spool-like collars 184 are attached to the transverse tendon plate 170 via the keyhole slots 172, 174 and 176**.

One nicety about the invention is that a child can continue to swing or rotate either arm 36, 38 past the uppermost position or 12 o'clock position without any damage being done to either actuating mechanism 110 or 112. All that happens is that the maximum distance between the axis 122 and the hand 52, as well as the maximum distance between the axis 124 and the hand 54, is again decreased as the arm 36 or 38, respectively, is rotated past the 12 o'clock or uppermost position.

Another feature of the invention resides in the fact that either hand 52 or 54 can be manually rotated about an axis longitudinal to the arm 36 or 38 to which it is connected, thereby simulating a wrist movement, without interfering or adversely affecting the pulling action developed by either actuating mechanism 110 or 112, as the case may be. This is made possible by the fact that any wrist rotation causes the tendon coupling unit 160, more specifically, the coupling ring 161, to merely rotate about the axis furnished by the shank 156, the axis of the shank 156 coinciding with the axis of the wrist rotation.

Inasmuch as either arm 36 or 38 can be raised independently of the other, plus the fact that the particular actuating mechanism 110 or 112 associated with that particular arm also functions independently, the child playing with the doll 10 has a number of choices. In FIG. 1, both arms 36 and 38 are shown raised, the hands 52 and 54 grasping or clasping a person's fingers labeled 194 and 196. It will be appreciated that the fingers of each hand are flexed simultaneously and can grasp very readily a thin object such as the child's fingers 194 and 196. This provides the child with some intrigue, being able to have the doll 10 hold other objects as well.

Figure 2:
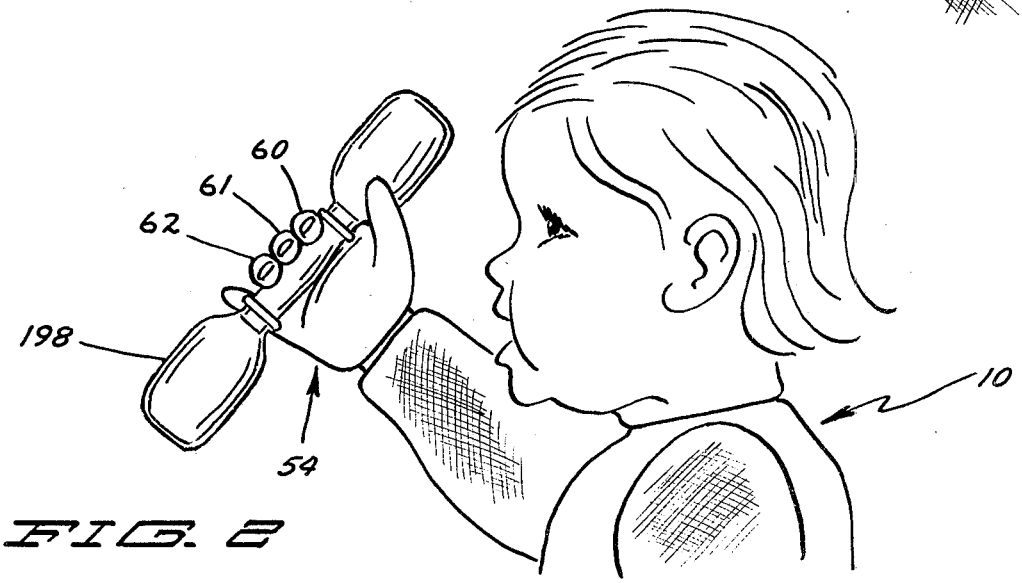
FIG. 2 is a side elevation of the upper portion of the doll, with its right hand partially raised so as to grasp a rattle.

To demonstrate the versatility of the invention, a rattle 198 has been depicted in FIG. 2. It is being held by the doll's right hand 54 which has its fingers 60, 61 and 62 only partially flexed by reason that the arm 38 has not been fully raised. It is believed obvious that the fully deflected or flexed condition appearing in FIG. 7, as represented by the dotted outline of the finger 61, need not be reached and that the flexible fingers 60, 61 and 62 will all yield to whatever degree is necessary so as to provide a pressual holding action for the object held.

Figure 3:
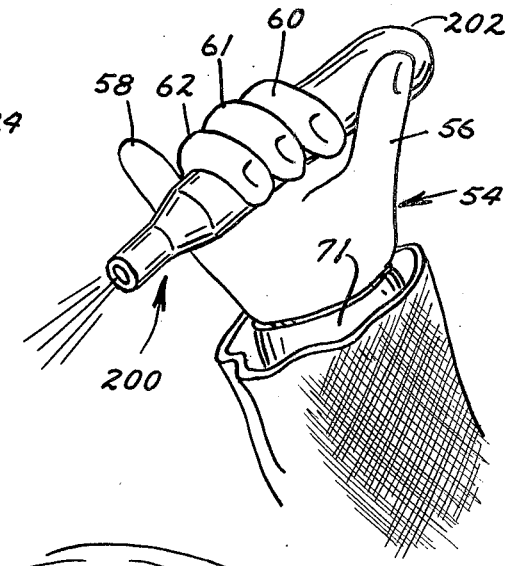
FIG. 3 is a view of only the right hand of the doll, the doll grasping in this view a so-called squeaker.

Still further, if the arm, say the right arm 38, is quickly raised, the clenching action is quite rapid. FIG. 3 pictures a squeaker 200 held and the clenched condition of the fingers 60, 61, 62 belonging to the right hand 54 and collapsing the bulb portion 202 so as to cause the speaker portion 204 to make a noise. In order to compress the bulb portion 202 of the squeaker 200 in order to force out a sufficient flow of air, the arm-raising action has to be fairly fast. However, the invention permits a rapid flexing of the fingers 60, 61, 62 to be realized.

What is claimed:

1. A doll comprising a torso, a first arm connected at one end to said torso for pivotal movement about a first shoulder axis, a first hand mounted at the other end of said arm including at least one flexible finger, and first actuating means responsive to pivotal movement of said arm for flexing said finger as said arm is swung about said shoulder axis, a second arm connected at one end to said torso for pivotal movement about a second shoulder axis, a second hand mounted at the other end of said second arm including at least one flexible finger, and second actuating means responsive to pivotal movement of said second arm for flexing said finger on said second hand independently of the finger on said first hand as said second arm is swung about said shoulder axis.

2. A doll in accordance with claim 1 in which each hand includes a plurality of flexible fingers, and said first actuating means simultaneously flexes the plurality of flexible fingers on said first hand, and said second actuating means simultaneously flexes the plurality of flexible fingers on said second hand independently of the plurality of fingers on said first hand.

3. A doll in accordance with claim 2 in which said hands are mounted to said arms for wrist rotation.

4. A doll in accordance with claim 3 in which said first and second actuating means each include at least one member extending from that particular arm into the hand mounted thereon which member is rotatable with the hand for that arm.

5. A doll in accordance with claim 4 in which said first actuating means is connected at one end to a third axis offset from said first shoulder axis and said second actuating means is connected at one end to a fourth axis offset from said second shoulder axis.

6. A doll in accordance with claim 5 in which said third axis is offset in a direction toward said first hand when said first arm is extending downwardly, and said fourth axis is offset in a direction toward said second hand when said second arm is extending downwardly.

7. A doll in accordance with claim 1 in which said actuating means is connected at one end to said torso at a location offset from said shoulder axis.

8. A doll in accordance with claim 7 in which said actuating means includes a pin at said offset location, said actuating means additionally including an angled resilient pull rod having a hole at one end encircling said pin to pivotally connect said one end of said actuating means to said offset location.

9. A doll in accordance with claim 8 in which said actuating means includes a flexible cable adjacent the other end connected to said finger for flexing said finger as said arm is swung about said shoulder axis.

10. A doll in accordance with claim 9 including a shoulder drum fixedly attached to said torso, said arm being mounted at its said one end for pivotal movement about said drum, said drum providing said shoulder axis.

11. A doll in accordance with claim 10 in which said pin projects from the outer side of said drum.

12. A doll in accordance with claim 11 in which said pin has a head thereon and a slot extending through said head so that said head can be flexed sufficiently to permit the hole in said pull rod to pass thereover.

13. A doll in accordance with claim 9 in which said flexible finger includes a flexible sleeve, said cable passing through said flexible sleeve, and a member affixed to the free end of said cable for bearing against the free end of said sleeve to cause flexing of said finger as said cable is pulled as a result of said arm being swung about said shoulder axis.

14. A doll in accordance with claim 13 in which said sleeve is provided with a plurality of spaced notches to facilitate flexing of said finger.

15. A doll comprising a torso, an arm connected at one end for pivotal movement about a first axis, a hand carried at the other end of said arm including a plurality of flexible fingers, each flexible finger having a flexible sleeve therein, a pull rod connected at one end for pivotal movement about a second axis offset from said first axis, a flexible cable extending through each sleeve, means connecting the other end of said pull rod to one end of said cables, and a member on the other end of each cable for acting against the ends of said sleeves to flex said sleeves and thus simulate the bending of fingers when said arm is swung about said first axis.

16. A doll in accordance with claim 15 in which said second axis is offset from said first axis in a direction toward said hand.

17. A doll in accordance with claim 16 in which said arm is substantially rigid and said pull rod at least somewhat resilient.

18. A doll in accordance with claim 17 in which said sleeves have spaced notches therealong to facilitate flexing thereof.

19. A doll in accordance with claim 18 in which said fingers include a layer of latex material covering said sleeves.

20. A doll in accordance with claim 19 in which said flexible fingers correspond to index, middle and ring fingers.

21. A doll in accordance with claim 20 including an extended rigid thumb and an extended rigid little finger, said flexible fingers being between said thumb and said little finger.

* * * * *